United States Patent [19]

Baumann

[11] Patent Number: 4,716,940

[45] Date of Patent: Jan. 5, 1988

[54] SAFEGUARD DEVICE FOR A WEAVING MACHINE

[75] Inventor: Heinz Baumann, Winterthur, Switzerland

[73] Assignee: Sulzer Brothers Ltd., Winterthur, Switzerland

[21] Appl. No.: 7,368

[22] Filed: Jan. 27, 1987

[30] Foreign Application Priority Data

Jan. 27, 1986 [CH] Switzerland ..... 00303/86

[51] Int. Cl.[4] ..... D03D 51/18

[52] U.S. Cl. ..... 139/336; 139/1 R; 139/353

[58] Field of Search ..... 139/1 R, 336 R, 353, 139/370.1, 370.2; 250/221, 559, 560; 66/157, 161; 19/0.21

[56] References Cited

U.S. PATENT DOCUMENTS

| | | | |
|---|---|---|---|
| 3,711,846 | 1/1973 | Schlisser et al. | 19/0.21 |
| 4,177,838 | 12/1979 | Van Wilson et al. | 139/353 |
| 4,248,272 | 2/1981 | Wilson et al. | 139/353 |
| 4,446,602 | 5/1984 | Marx et al. | 19/0.21 |

*Primary Examiner*—Henry S. Jaudon

*Attorney, Agent, or Firm*—Kenyon & Kenyon

[57] ABSTRACT

The safeguard device has a light beam emitter secured to a pivotal lever for movement between an operative position and a retracted position. In addition, a plate is pivotally mounted relative to the lever to move with the lever. The plate is formed with a recess to expose the light beam when the lever is in an operative position and is otherwise shaped to mask the emitter when the lever is pivoted into a retracted position. Masking of the light beam serves to signal a need for interrupting the operation of the weaving machine.

16 Claims, 4 Drawing Figures

SAFEGUARD DEVICE FOR A WEAVING MACHINE

This invention relates to a safequard device for a weaving machine. More particularly, this invention relates to a safequard device for a nip and/or cutting zone of a weaving machine. Still more particularly, this invention relates to a safeguard device for a temple zone in a weaving machine.

As is known, various types of safeguard devices have been employed on weaving machines in order to protect against injury to the operating personnel. For example, Swiss Patent 651,864 describes a safeguard device which is employed in a weaving machine having a hinge or pivoted cover or hood for the zone to be protected. This safeguard device functions to prevent the operation of the weaving machine while the hood is open. To this end, the safeguard device establishes a light barrier between two temples of the machine by means of a light beam emitter on one temple and a light beam receiver on the other temple. When the hood is raised, the hood itself masks or interrupts the beam from the light beam emitter. Alternatively, a light beam reflector can be mounted on the hood for pivoting away from the beam zone when the hood rises so as to interrupt the light barrier.

However, in cases where a hood is not available on a weaving machine, rather complex safeguard devices have been employed.

Accordingly, it is an object of the invention to provide a simple safeguard device for a weaving machine which can be used whether or not a hood or the like is present.

It is another object of the invention to provide a safeguard device for a weaving machine which can function reliably.

It is another object of the invention to provide a photoelectric safeguard device which permits reliable interruption of a light barrier.

It is another object of the invention to provide for access to a weaving machine for servicing and repairs without obstruction by a safeguard device.

Briefly, the invention provides a safeguard device for a weaving machine which can be employed, for example, in a temple zone between a reed and a pair of temples which are spaced from the reed. The safeguard device includes a light beam emitter which is mounted on one temple for directing a light beam across the weaving machine and a light beam receiver on the other temple for receiving the light beam from the emitter. In addition, a lever having one of the emitter or receiver thereon is pivotally mounted between an operative position and a retracted position while a plate is pivotally mounted relative to the lever for masking the light beam when the lever is in the retracted position. The plate also has a recess for exposing the emitter to the receiver when the lever is in the operative position.

The lever and plate are coupled together so that a simple raising of the lever from the operative position causes the plate to interrupt the light beam. To this end, the coupling arrangement includes a pin which is secured to the lever and a slot in the plate receiving the pin in guided relation for simultaneously pivoting the plate with the lever in response to pivoting of the lever. The plate may also be provided with a finger-like projection adjacent to the recess for masking the emitter in initial response to pivoting of the lever from the operative position towards the retracted position. The slot in the plate is also shaped so that continued pivoting of the lever causes the plate to move relative to the lever so that a main portion of the plate masks the emitter, i.e. interrupts the light beam.

The safeguard device is of relatively simple construction. In this regard, the light beam can be interrupted simply by actuation of the lever independently of any hoods or electrical circuitry so that the weaving machine can be stopped, for example for servicing and repairs. Further, moving the lever from the operative position to the retracted position ensures good accessibility in the temple and edge zones of the weaving machine.

These and other objects and advantages of the invention will become more apparent from the following detailed description taken in conjunction with the accompanying drawings wherein.

Figure 1:
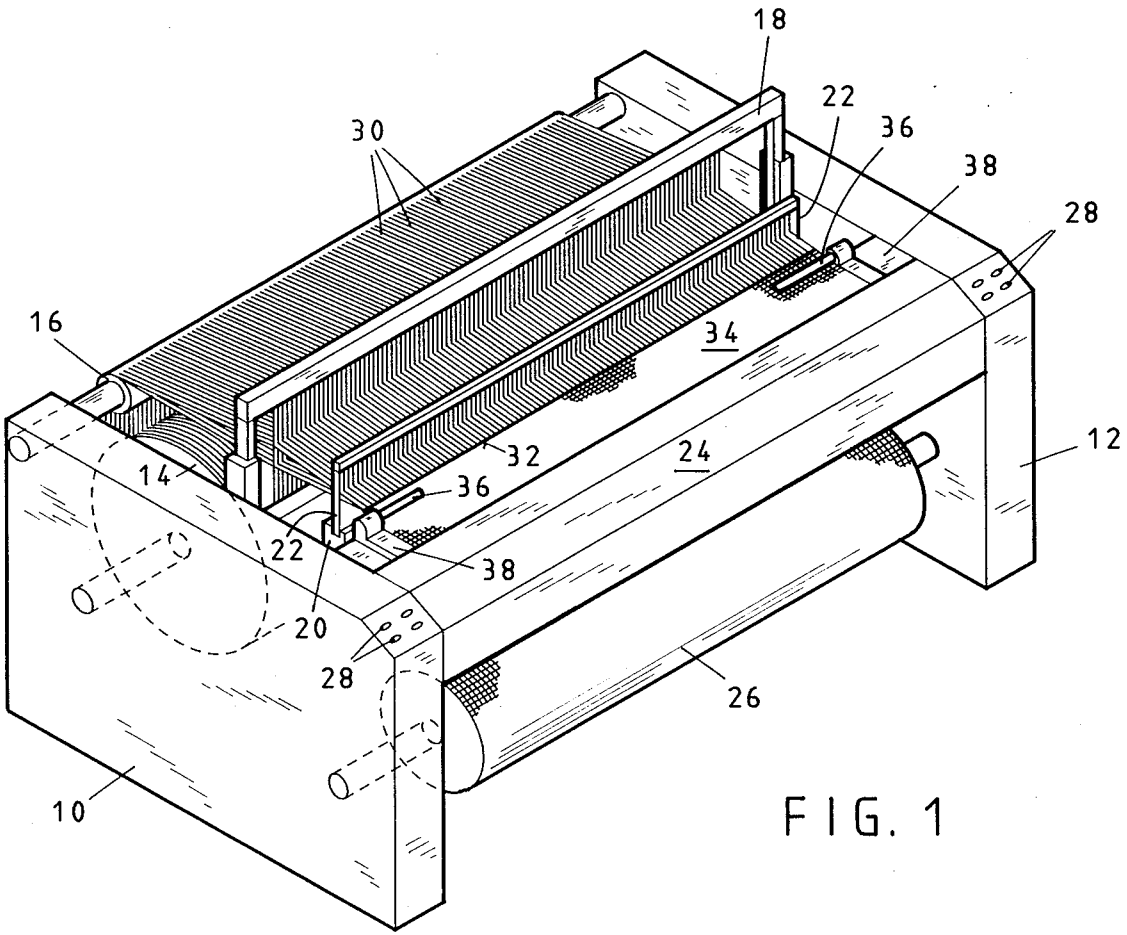
FIG. 1 illustrates a diagrammatic perspective view of a weaving machine employing a safeguard device constructed in accordance with the invention.

Referring to FIG. 1, the weaving machine includes a pair of uprights or side walls 10, 11 between which a warp beam 14, a breast beam 16, a sheeding motion 18, an oscillable sley 20 carrying a reed 22, a beam rail 24 and a cloth beam 26 are mounted. In addition, a console-like control zone having a number of switches 28 for different kinds of operation is mounted on each of the walls 10, 12. During operation, warp yarns 30 run, in known manner, from the warp beam 14 to a fell 32 where the last weft yarn to be picked is beaten up by the reed 22 to produce a cloth 34.

A temple 36 is disposed at each cloth edge immediately after the fell 32 as considered in the direction of cloth movement. As indicated, each temple 36 is secured to a table on a carrier 38 connected to a respective wall 10, 11.

The picking system is of conventional structure and need not be further described. For example, the weaving machine may be a projectile weaving machine or an air jet weaving machine. The picking direction is from left to right as viewed in FIG. 1.

Figure 2:
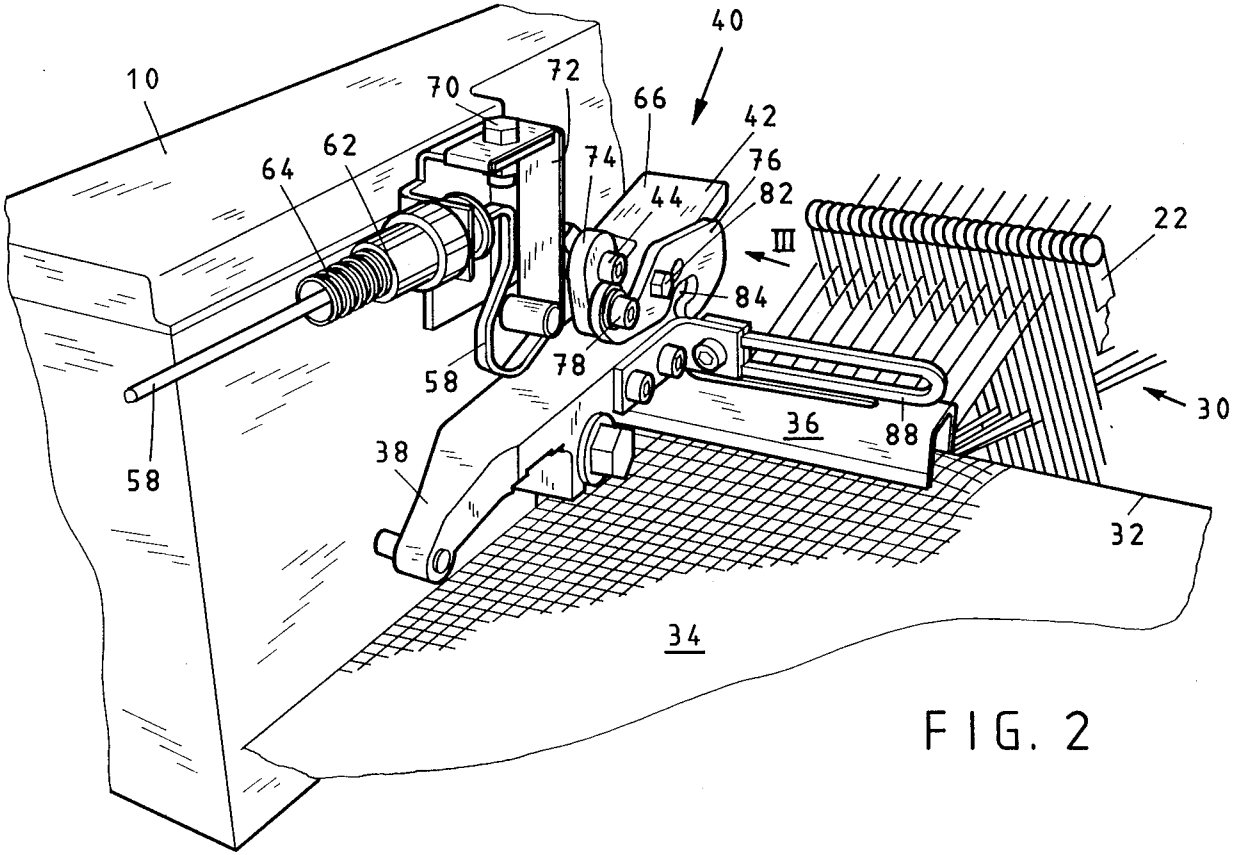
FIG. 2 illustrates an enlarged perspective view of a temple zone of the weaving machine of FIG. 1 in accordance with the invention.

Referring to FIG. 2, a safeguard device 40 is disposed in the temple zone between the reed 22 and the respective temples 36. In this regard, the safeguard device is of a photoelectric type in order to establish a light barrier across the weaving machine so that objects placed in the light barrier can indicate, for example, a need for an interruption in the operation of the weaving machine.

Figure 3:
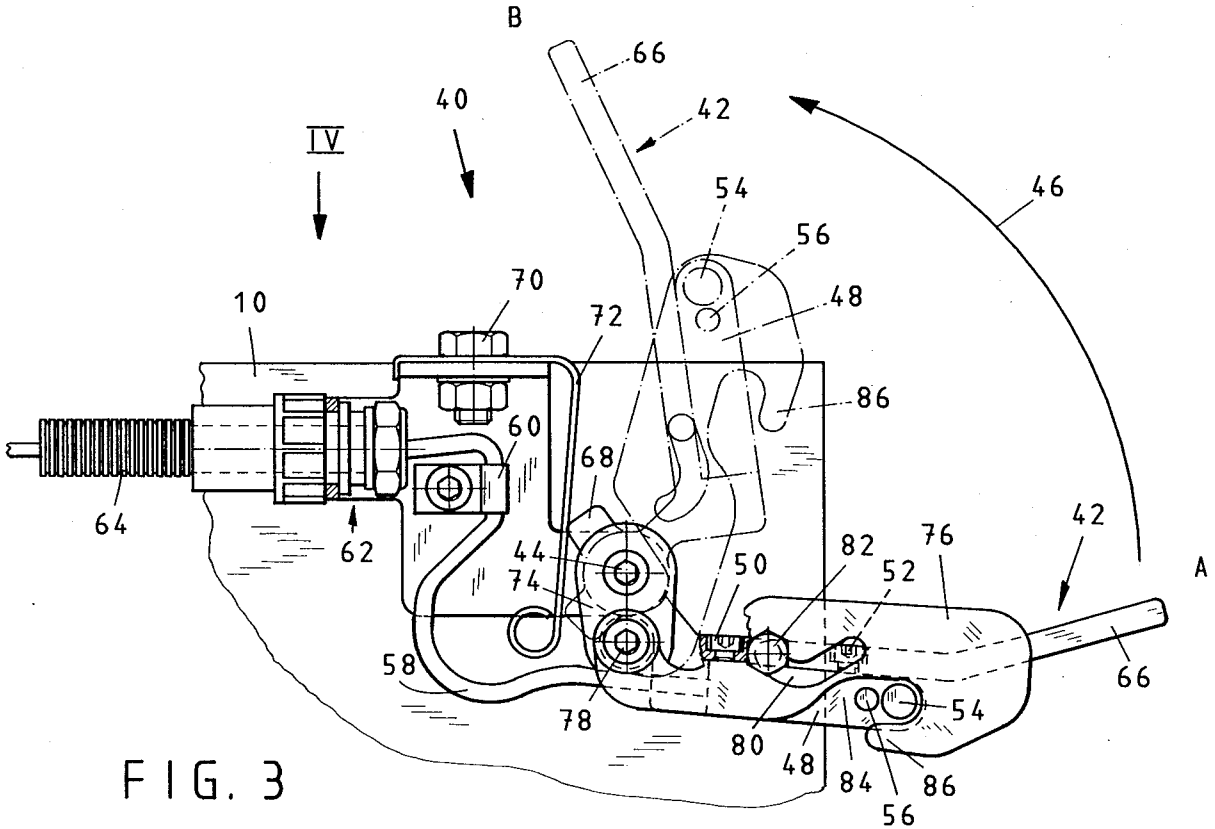
FIG. 3 illustrates a side view of the safeguard device of FIG. 2.

As indicated, the safeguard device 40 is mounted on the carrier 38 above the temple 36 on one side of the weaving machine. The device 40 includes a lever 42 which is pivotally mounted on a fixed pin 44 for pivoting between an operative position, as shown in FIG. 2, and a retracted position as shown in dotted line in FIG. 3. As indicated in FIG. 3, the lever 42 pivots in the direction indicated by the arrow 46 about the pin 44 when moving towards the retracted position. As indicated, a light beam emitter 48 is secured by screws 50, 52 to the lever 42. This emitter 48 has a lens 54, a light-emitting diode 56 and a cable 58 connected to a power supply (not shown) by way of a cable clamp 60, coupling sleeve 62 and flexible cable 64. The lens 54 serves to focus a light beam from a light source of the emitter 48 and to direct the light beam across the width of the weaving machine onto a light beam receiver on the opposite temple 36. The light-emitting diode 56 serves to indicate the state of operation of the safeguard device 40, for example being on if the safeguard device 40 is on.

Figure 4:
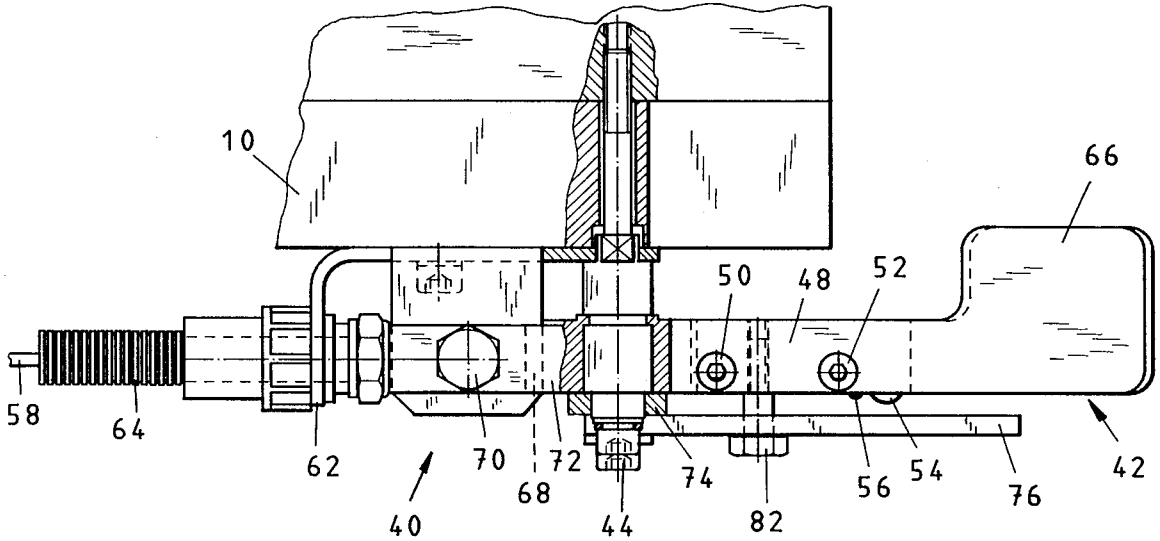
FIG. 4 illustrates a plan view of the safeguard device of FIG. 2.

Referring to FIGS. 2, 3 and 4, the pivotal lever 42 has a control grip in the form of a widening 66 at the free end to facilitate pivoting of the lever manually. The opposite end of the lever 42 has a cam 68 for pressing against a spring strip 72 which is secured by a screw 70 to the wall 10.

The safeguard device 40 also has a stationary lug 74 secured to the pin 44 adjacent to the lever 42. In addition, a plate 76 is pivotally mounted on the lug 74 by way of a pin 78 (see FIGS. 2 and 3) for pivoting relative to the lever 42. In this regard, the plate 76 is coupled to the lever 42 so as to perform an articulated motion relative to the lever 42 during pivoting of the lever 42. To this end, the plate 76 is formed with a curved slot or groove 80 while a pin 82 secured to the lever 42 is received in the slot 80 for guided relation. As indicated in FIG. 3, when the lever 42 is in the operative position, the pin 82 is located at the left-hand end of the slot 80, as viewed. When the lever 42 initially begins to pivot upwardly from the operative position, the plate 76 is caused to pivot about the pin 78 through the connection afforded by the pin 82 in the slot 80. However, since the lever 42 and plate 76 pivot about different pivot points as indicated in FIG. 3, the pin 82 begins to slide within the slot 80 so as to follow the contour of the slot 80. As shown, the slot is shaped with a somewhat flattened V-shape so that the pin 82 initially causes lifting of the plate 76 relative to the lens 54. Thereafter, the pin 82 moves to the right-hand end of the slot 80 as indicated in dotted line so that the main end portion of the plate 76 masks over the lens 54.

As shown in FIG. 3, the plate 76 is formed with a substantially slot-like recess 84 and a finger-like projection 86 adjacent the recess 84. The recess 84 is sized so that when the lever 42 is in the operative position, the lens 54 is unobstructed. However, as the lever 42 begins to pivot towards the retracted position, the projection 86 masks over the lens 54.

Referring to FIG. 2, a guard stirrup 88 is disposed between the safeguard device 40 and the temple 36 to prevent passage of the light beam from the emitter 48 to the temple 36. A similar structure is provided on the opposite side of the machine in association with the light beam receiver (not shown).

When the safeguard device 40 is in the operative state corresponding to the position A of the lever 42 in FIG. 3, the light beam from the lens 54 is free to pass through the recess 84 to be received by the receiver on the opposite side of the weaving machine. In the event that the beam is interrupted, for example, because someone accidentally moves his hand into the temple zone, the weaving machine is interrupted immediately, the light-emitting diode 56 indicating the state of operation.

In order to interrupt operation of the weaving machine deliberately, for example, so that servicing work can be performed in the temple zone, the lever 42 is raised in the direction indicated by the arrow 46. As a result of the cooperation between the slot 80 and the pin 82, the plate 76 first pivots counterclockwise so that the projection 86 immediately masks the lens 54. As the lever 42 pivots further, the plate 76 moves in the opposite direction so that when the lever 42 is in the end position B, the lens 54 and diode 56 are completely masked behind the plate 76. In this position, for example, servicing can be performed conveniently even in the edge zone of the machine. The cam 68 which presses on the spring strip 72 ensures reliable retention of the lever 42 in the retracted position B.

The safeguard device may be constructed so that the pivotal lever and plate are mounted on the light receiver side of the weaving machine. In this case, the lever may have the light beam receiver mounted thereon while the plate is pivotally mounted for masking the light beam when in a retracted position of the lever while exposing the emitter to the receiver in the operative position of the lever.

The safeguard device 40 can be arranged to operate, for example, only during starting of the weaving machine, for example by means of an appropriate release system. The safeguard device is also useful for multicloth weaving with or without intermediate selvedge tuckers.

The invention thus provides a safeguard device for a weaving machine which is of relatively simple construction. Further, the safeguard device operates on a photoelectric principle so that an interrupted light beam indicates a need to interrupt operation of the weaving machine. Further, the safeguard device can be simply pivoted out of the way when operation is not required, for example during servicing of the weaving machine.

What is claimed is:

1. In a weaving machine, the combination of
a reed;
a pair of temples spaced from said reed to define a temple zone between said reed and said temples;
a light beam emitter on one temple for directing a light beam to the other temple;
a light beam receiver on said other templer to receive the light beam from said emitter;
a lever having said emitter thereon and pivotally mounted between an operative position and a retracted position; and
a plate pivotally mounted relative to said lever for masking said emitter in said retracted position of said lever and having a recess for exposing said emitter in said operative position of said lever.

2. The combination as set forth in claim 1 which further comprises a pin secured to said lever and a slot in said plate receiving said pin in guided relation for simultaneously pivoting said plate with said lever in response to pivoting of said lever.

3. The combination as set forth in claim 1 which further comprises a stationary lug having said plate pivotally mounted thereon for pivoting relative to said lever.

4. The combination as set forth in claim 1 which further comprises a spring strip and a cam at one end of said lever for pressing against said spring strip to retain said lever in said retracted position.

5. The combination as set forth in claim 1 wherein said plate has a finger-like projection adjacent said recess for masking said emitter in initial response to pivoting of said lever from said operative position towards said retracted position.

6. The combination as set forth in claim 1 wherein said lever has a control grip at a free end thereof.

7. The combination as set forth in claim 1 which further comprises a light-emitting diode adjacent said emitter for indicating the state of operation of the weaving machine.

8. The combination as set forth in claim 1 which further comprises a guard stirrup between said emitter and said one temple to prevent passage of the light beam to said one temple.

9. A safeguard device for a weaving machine comprising a light beam emitter for directing a light beam across the weaving machine;

a light beam receiver for receiving the light beam for said emitter;

a lever having one of said emitter and said receiver thereon and pivotally mounted between an operative position and a retracted position; and a plate pivotally mounted relative to said lever for masking the light beam in said retracted position of said lever and having a recess for exposing said emitter to said receiver in said operative position of said lever.

10. A safeguard device as set forth in claim 9 which further comprises a pin secured to said lever and a slot in said plate receiving said pin in guided relation for simultaneously pivoting said plate with said lever in response to pivoting of said lever.

11. A safeguard device as set forth in claim 9 which further comprises a stationary lug having said plate pivotally mounted thereon for pivoting relative to said lever.

12. A safeguard device as set forth in claim 9 wherein said plate has a finger-like projection adjacent said recess for masking said emitter in initial response to pivoting of said lever from said operative position towards said retracted position.

13. A safeguard device as set forth in claim 9 wherein said emitter is mounted on said lever.

14. In a weaving machine, the combination comprising a reed;

a pair of temples spaced from said reed to define a temple zone between said reel and said temples; and a safeguard device for forming a light barrier in said zone, said device including a light beam emitter for directing a light beam across said zone, a light beam receiver for receiving the light beam from said emitter, a lever having one of said emitter and said receiver thereon and pivotally mounted between an operative position and a retracted position, and a plate pivotally mounted relative to said lever for masking the light beam in said retracted position of said lever and having a recess for exposing said emitter to said receiver in said operative position of said lever.

15. The combination as set forth in claim 14 which further comprises a pin secured to said lever and a slot in said plate receiving said pin in guided relation for simultaneously pivoting said plate with said lever in response to pivoting of said lever.

16. The combination as set forth in claim 14 which further comprises a stationary lug having said plate pivotally mounted thereon for pivoting relative to said lever.

* * * * *

UNITED STATES PATENT AND TRADEMARK OFFICE

CERTIFICATE OF CORRECTION

PATENT NO. : 4,716,940

DATED : January 5, 1988

INVENTOR(S) : HEINZ BAUMANN

It is certified that error appears in the above-identified patent and that said Letters Patent is hereby corrected as shown below:

Column 2, line 31 "sheeding" should be -shedding-

Column 5, line 11 "for" (second occurrence) should be -from-

Column 6, line 9 "reel" should be -reed-

Signed and Sealed this

Twelfth Day of July, 1988

*Attest:*

*Attesting Officer*

DONALD J. QUIGG

*Commissioner of Patents and Trademarks*